US009417562B2

(12) United States Patent
Komatsuzaki et al.

(10) Patent No.: US 9,417,562 B2
(45) Date of Patent: Aug. 16, 2016

(54) RECOVERY DEVICE AND IMAGE FORMING APPARATUS FOR RECOVERING LIQUID DEVELOPER AND PASSING THE LIQUID DEVELOPER THROUGH A POROUS SECTION

(71) Applicant: FUJI XEROX CO., LTD., Tokyo (JP)

(72) Inventors: Kazunari Komatsuzaki, Kanagawa (JP); Taichi Yamada, Kanagawa (JP); Shiro Suzuki, Kanagawa (JP); Kazutoshi Yatsuda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/810,902

(22) Filed: Jul. 28, 2015

(65) Prior Publication Data

US 2016/0209779 A1 Jul. 21, 2016

(30) Foreign Application Priority Data

Jan. 16, 2015 (JP) ..... 2015-006856

(51) Int. Cl.
*G03G 15/10* (2006.01)

(52) U.S. Cl.
CPC ..... *G03G 15/105* (2013.01); *G03G 15/10* (2013.01); *G03G 15/104* (2013.01)

(58) Field of Classification Search
CPC .... G03G 15/11; G03G 15/104; G03G 15/105
USPC ..... 399/237, 249
See application file for complete search history.

(56) References Cited

U.S. PATENT DOCUMENTS 4,860,050 A * 8/1989 Kurotori ..... G03G 15/104 399/238
5,530,533 A * 6/1996 Wallace ..... G03G 15/104 399/237
2012/0294653 A1* 11/2012 Gomi ..... G03G 15/11 399/249

FOREIGN PATENT DOCUMENTS

JP 2000-338785 A 12/2000
JP 2007256662 A * 10/2007
JP 2011-175210 A 9/2011

OTHER PUBLICATIONS

English Translation of Takenaka et al. "Liquid Developing Device and Wet Image Forming Apparatus" Oct. 4, 2007, Japanese Patent Office. JP2007-256662.*

* cited by examiner

*Primary Examiner* — Clayton E Laballe
*Assistant Examiner* — Trevor J Bervik
(74) *Attorney, Agent, or Firm* — Oliff PLC

(57) ABSTRACT

Provided is a recovery device including a recovery mechanism that recovers a liquid developer from a holding member which revolves while holding the liquid developer, the liquid developer being not delivered from the holding member to a delivery target member and remains on the holding member, a reception section that receives the liquid developer which the recovery mechanism recovers, an addition member that adds a diluent, which reduces a toner concentration of the liquid developer, to the liquid developer that the reception section receives, a porous section through which the liquid developer passes, and a transport member that moves to transport the liquid developer which the reception section receives to the porous section, and causes the liquid developer to pass through the porous section.

6 Claims, 8 Drawing Sheets

RECOVERY DEVICE AND IMAGE FORMING APPARATUS FOR RECOVERING LIQUID DEVELOPER AND PASSING THE LIQUID DEVELOPER THROUGH A POROUS SECTION

CROSS-REFERENCE TO RELATED APPLICATIONS

This application is based on and claims priority under 35 USC 119 from Japanese Patent Application No. 2015-006856 filed Jan. 16, 2015.

BACKGROUND

Technical Field

The present invention relates to a recovery device and an image forming apparatus.

SUMMARY

When liquid developer is recovered from a developing member, an image holder, or an intermediate holding member, a toner aggregate, in which toner (toner particles) are aggregated, is included in the recovered liquid developer. The reason for this is that toner is charged as a result of being electrified in each process, and charged toner aggregates and forms toner aggregates. As a method for dispersing toner aggregates, a method that passes liquid developer that includes toner aggregates through a porous section may be considered. However, even if recovered liquid developer is passed through a porous section without change, there are cases in which the toner aggregates are not dispersed.

According to an aspect of the invention, there is provided a recovery device including:

a recovery mechanism that recovers a liquid developer from a holding member which revolves while holding the liquid developer, the liquid developer being not delivered from the holding member to a delivery target member and remains on the holding member;

a reception section that receives the liquid developer which the recovery mechanism recovers;

an addition member that adds a diluent, which reduces a toner concentration of the liquid developer, to the liquid developer that the reception section receives;

a porous section through which the liquid developer passes; and a transport member that moves to transport the liquid developer which the reception section receives to the porous section, and causes the liquid developer to pass through the porous section.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1:
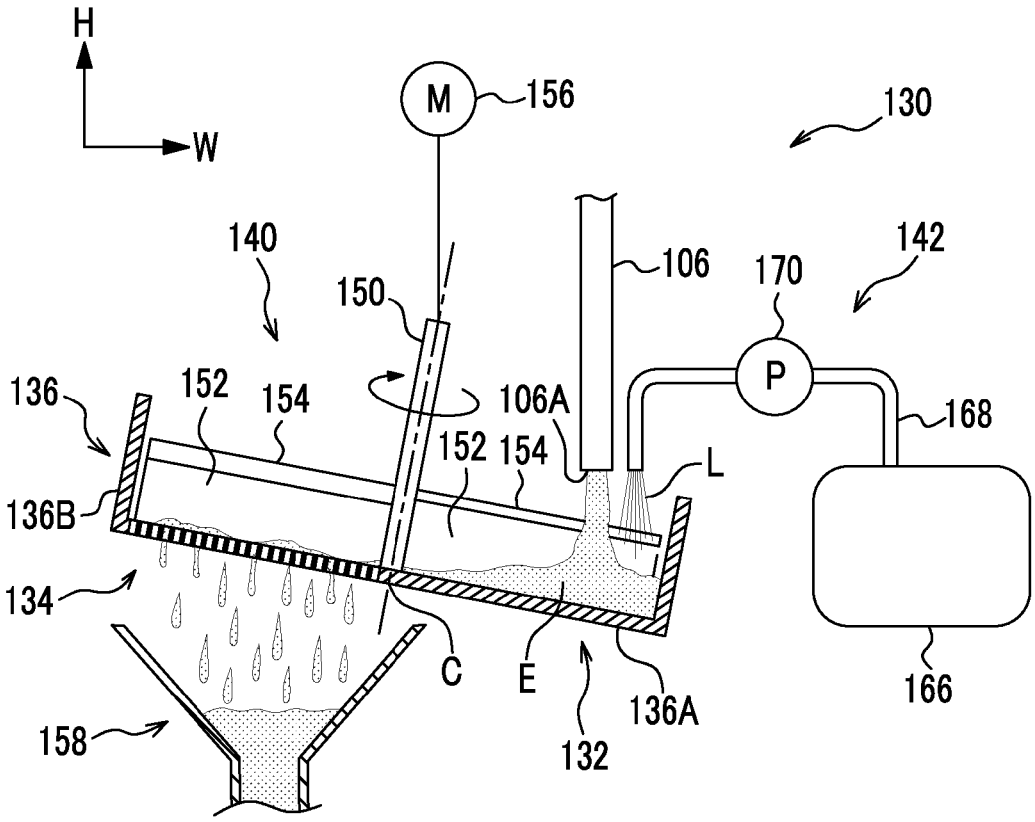
FIG. 1 is a configuration diagram that shows a recovery device and the like according to a first exemplary embodiment of the present invention.

An example of a recovery device and an image forming apparatus according to a first exemplary embodiment of the present invention will be described with reference to FIGS. 1 to 6. In the drawings, an arrow H shows an up-down direction (a vertical direction), and an arrow W shows a device width direction (a horizontal direction).

Overall Configuration

Figure 6:
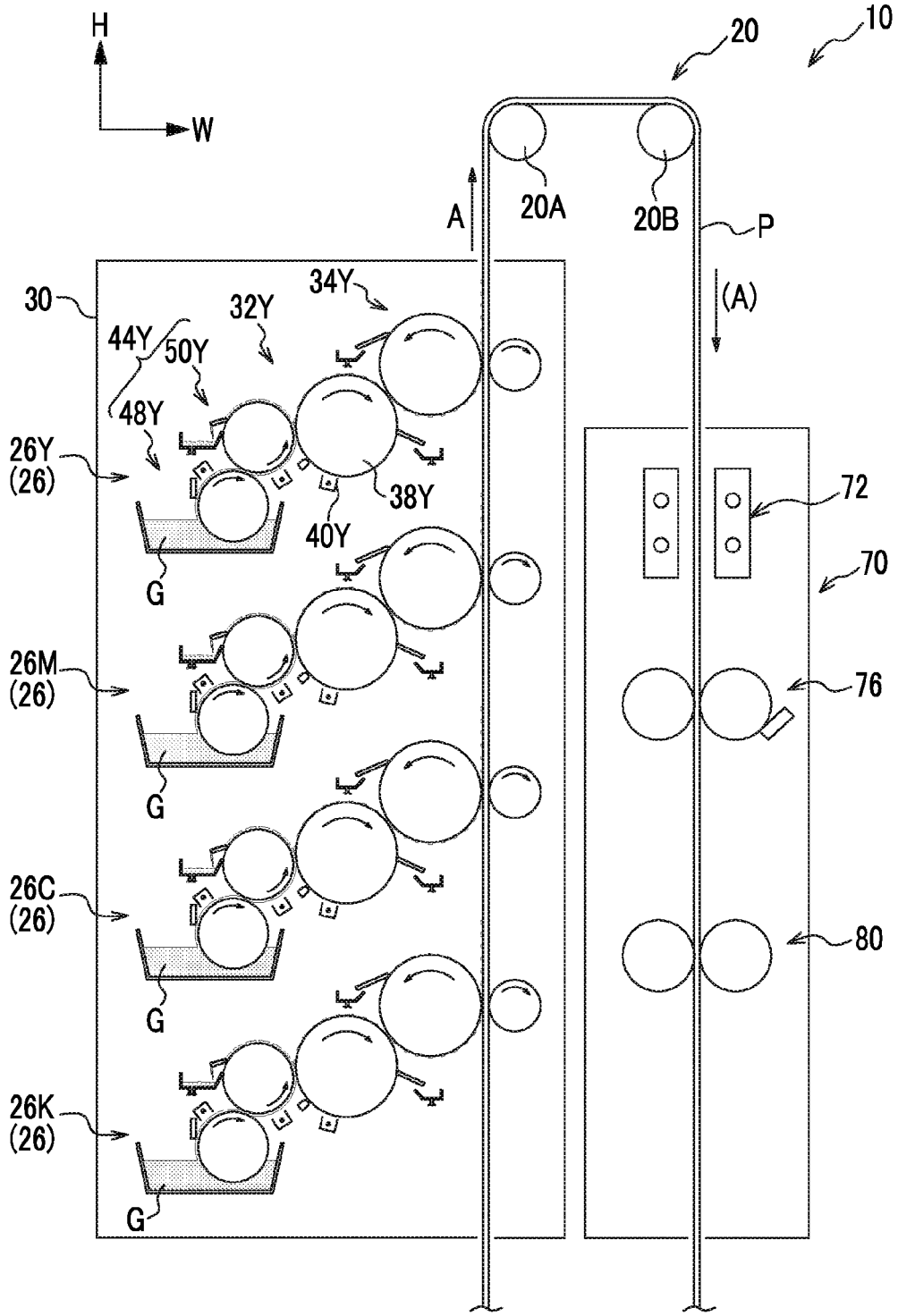
FIG. 6 is a schematic configuration diagram that shows the image forming apparatus according to the first exemplary embodiment of the present invention.

As shown in FIG. 6, an image forming apparatus 10 is provided with a transport unit 20, which transports continuous paper P as a recording medium, image forming sections 26, which form toner images, and a fixing device 70, which fixes the toner images onto the continuous paper P.

Transport Unit

The transport unit 20 has a function of transporting the continuous paper P in a direction (a transport direction) of an arrow A, which is illustrated in the drawings, at a predetermined transport speed. The transport unit 20 is provided with a pair of transport rollers 20A and 20B, around which the continuous paper P is wound, and which are disposed aligned in the device width direction. Further, the transport roller 20A is disposed on an upstream side (the left side in the drawing) in the transport direction (hereinafter, referred to as a "medium transport direction") of the continuous paper P with respect to the transport roller 20B.

In this configuration, the continuous paper P on the upstream side with respect to the transport roller 20A in the medium transport direction is transported from a lower side in the drawing to an upper side, and the continuous paper P on the downstream side with respect to the transport roller 20B in the medium transport direction is transported from an upper side in the drawing to a lower side.

Image forming Sections

The image forming sections 26 include an image forming section 26Y, which forms yellow (Y) images, an image forming section 26M, which forms magenta (M) images, an image forming section 26C, which forms cyan (C) images, and an image forming section 26K, which forms black (K) images. Further, the image forming section 26K, the image forming section 26C, the image forming section 26M and the image forming section 26Y are disposed in this order from the upstream side in the medium transport direction. In addition, the image forming section 26K, the image forming section 26C, the image forming section 26M and the image forming section 26Y are disposed inside a housing 30.

In the description below, in cases in which it is not particularly necessary to discriminate between the image forming sections 26, the symbols "Y", "M", "C" and "K" will be omitted therefrom.

Figure 5:
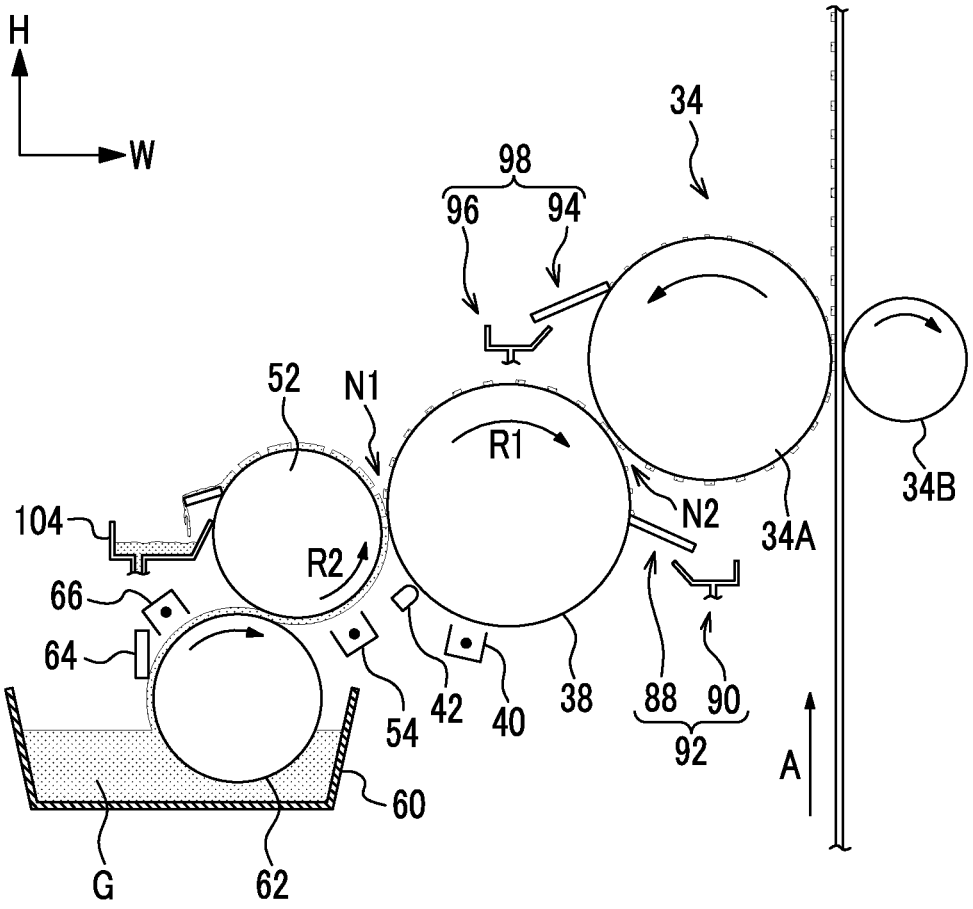
FIG. 5 is a configuration diagram that shows the developing device and the like of the image forming apparatus according to the first exemplary embodiment of the present invention.

As shown in FIG. 5, the image forming section 26 (not shown in FIG. 5) is provided with an image forming unit 32 (not shown in FIG. 5) for forming toner images using a liquid developer G, a transfer unit 34 for transferring toner images formed by the image forming unit 32 to the continuous paper P.

Additionally, the liquid developer G that is used in the present exemplary embodiment is liquid developer G of a liquid type that is obtained by dispersing powder toner in a non-volatile oil.

Image Forming Unit

The image forming unit 32 is provided with an image holder 38, which holds toner images, an electrification device 40, which electrifies the image holder 38, an exposure device 42, which forms an electrostatic latent image by irradiating the image holder 38 with exposure light, and a developing device (not shown in FIG. 5), which develops the electrostatic latent image on the image holder 38 into a toner image.

Image Holder

The image holder 38 is configured to be a cylinder, and is driven to rotate (revolve) about an axis (in a direction of an arrow R1) by a driving unit (not shown in the drawings). The image holder 38 includes an aluminum substrate, and a photosensitive layer (not shown in the drawings) in which an undercoating layer, a charge generation layer, and a charge transport layer are formed in order above the substrate.

Furthermore, a recovery device 92 that is provided with a scraping blade 88 that scrapes away liquid developer G, which is not transferred from the image holder 38 to a transfer roller 34A (which will be described later) and remains on the image holder 38, from the image holder 38, and a recovery member 90 that recovers the liquid developer G which is scraped away, is provided.

In addition, a removal member (not shown in the drawings) which removes oil that is included in the liquid developer G, from the liquid developer G on the image holder 38 before a toner image is transferred to the transfer roller 34A, is provided.

Electrification Device

In the present exemplary embodiment, the electrification device 40 is configured as a scorotron type charging device, and is disposed so as to face the image holder 38. Further, the electrification device 40 is set so as to electrify the image holder 38.

Exposure Device

The exposure device 42 is configured as an LED print head, and is disposed so as to face the image holder 38 on a downstream side of the electrification device 40 in a rotational direction of the image holder 38. Further, the exposure device 42 forms an electrostatic latent image on the image holder 38 by irradiating the image holder 38, which has been electrified by the electrification device 40, with exposure light.

Developing Device

The developing device 44 is provided with a developing unit 50 (not shown in FIG. 5), which delivers the liquid developer G to the electrostatic latent image that is formed on the image holder 38, and a supply unit 48 (not shown in FIG. 5), which supplies the liquid developer G to the developing unit 50.

Developing Unit

The developing unit 50 is cylindrical and is provided with a developing roller 52, as one example of a developing member, which is driven to rotate (revolve) about an axis (in a direction of an arrow R2) by a driving unit (not shown in the drawings), and an electrification member 54, which is disposed to face the developing roller 52. Furthermore, the developing unit 50 is provided with a recovery device 100 (not shown in FIG. 5), which recovers liquid developer G that remains on the developing roller 52.

The developing roller 52 is configured so that a developing voltage is applied thereto by a power source (not shown in the drawings), and an electric field for developing the electrostatic latent image that is formed on the image holder 38, is formed between the developing roller 52 and the image holder 38 (in a nipped section N1).

Furthermore, an electric field for supplying the liquid developer G from a supply roller 62, which will be described later, to the developing roller 52, is formed between the developing roller 52 and the supply roller 62.

In the present exemplary embodiment, the electrification member 54 is configured as a scorotron type charging device, and is used in order to electrify toner that is included in the liquid developer G. The electrification member 54 is disposed so as to face the developing roller 52 on an upstream side with respect to the nipped section N1 in a rotational direction of the developing roller 52. Additionally, the recovery device 100 will be described in detail later.

In this configuration, the electrification member 54 electrifies toner that is included in the liquid developer G and is supplied to the developing roller 52, and the liquid developer G, which includes the electrified toner, is delivered from the developing roller 52 to the electrostatic latent image that is formed on the image holder 38. As a result of this, the developing unit 50 develops the electrostatic latent image, which is formed on the image holder 38 as a toner image. Additionally, in a case in which the electrostatic latent image is developed into a toner image using the liquid developer G, oil also migrates to the image holder 38.

Supply Unit

The supply unit 48 is provided with a developer tank 60, which is disposed on a lower side of the developing roller 52 and accommodates the liquid developer G, and the supply roller 62, which supplies the liquid developer G to the developing roller 52 by drawing up the liquid developer G from the developer tank 60. In addition, the supply unit 48 is provided with a blade 64, which adjusts a layered film of the liquid developer G that is adhered to the supply roller 62, and an electrification device 66, which, as one example, positively electrifies toner that is included in the liquid developer G, which is adhered to the supply roller 62.

In this configuration, the supply roller 62, which is driven to rotate, draws up the liquid developer G that is accommodated in the developer tank 60. Then, the blade 64 adjusts the layered film of the liquid developer G, and the electrification device 66 electrifies the toner that is included in the liquid developer G. Furthermore, the liquid developer G, which is drawn up by the supply roller 62, is supplied to the developing roller 52 as a result of to the electric field formed between the supply roller 62 and the developing roller 52. As a result of this, a film (a layer) of the liquid developer G is formed on the developing roller 52.

Transfer Unit

The transfer unit 34 is provided with the transfer roller 34A, which is disposed to face the image holder 38 and to which a toner image, which is held by the image holder 38, is transferred, as an example of an intermediate holding member. Furthermore, the transfer unit 34 is provided with a backup roller 34B, which is disposed on an opposite side to the transfer roller 34A with the continuous paper P interposed therebetween, as an example of a transfer member.

A primary transfer voltage, which is caused by a power source (not shown in the drawings), is applied to the transfer roller 34A. As a result of this, an electric field for transferring the toner image on the image holder 38 to the transfer roller 34A, is formed between the transfer roller 34A and the image holder 38 (in a nipped section N2).

In addition, a secondary transfer voltage, which is caused by a power source (not shown in the drawings), is applied to the backup roller 34B. As a result of this, an electric field for transferring the toner image on the transfer roller 34A to the continuous paper P, is formed between the backup roller 34B and the transfer roller 34A.

Furthermore, a recovery device 98, which is provided with a scraping blade 94, which scrapes away liquid developer G, which is not transferred from the transfer roller 34A to the continuous paper P and remains on the transfer roller 34A, from the transfer roller 34A, and a recovery member 96 that recovers the liquid developer G which is scraped away, is provided.

In this configuration, the toner image that is held by the image holder 38 is transferred to the transfer roller 34A, and the toner image, which is transferred to the transfer roller 34A, is transferred to the continuous paper P. Additionally, the oil, which migrates from the developing roller 52 to the image holder 38, migrates to the continuous paper P through the transfer roller 34A in the same manner.

Fixing Device

As shown in FIG. 6, the fixing device 70 is provided with a heating section 72, which heats the continuous paper P, an oil removal section 76, which removes the oil from the continuous paper P, and a fixing section 80, which fixes toner images to the continuous paper P.

In this configuration, the continuous paper P is heated by the heating section 72, toner and oil, which are included in the liquid developer G that is on the continuous paper P, separate, and a layer of oil is formed in a layer, which is above the toner.

Furthermore, oil on the upper layer is removed by the oil removal section 76, the continuous paper P is heated and pressurized by the fixing section 80, and a toner image is fixed to the continuous paper P.

Actions of Overall Configuration

The image holder 38 of the image forming unit 32 for each color rotates, and the image holder 38 is electrified by the electrification device 40 (refer to FIG. 5).

Next, the exposure device 42 exposes the image holder 38, which has been electrified, depending on image data, which is received from an image signal processing section (not shown in the drawings), and an electrostatic latent image (not shown in the drawings) is formed on the image holder 38. Further, the electrostatic latent image is developed into a toner image by the developing device 44.

The toner image that is formed on the image holder 38, which rotates, is primarily transferred to the transfer roller 34A.

The toner image, which is primarily transferred to the transfer roller 34A, is transferred to the continuous paper P, which is transported. At this time, oil also migrates to the continuous paper P with the toner image. This step is performed by the image forming section 26 for each color, and a toner image, in which each color overlaps with other colors, is formed on the continuous paper P.

Furthermore, the oil of the continuous paper P, which is transported, is removed by the fixing device 70, and the toner image is fixed to the continuous paper P (refer to FIG. 6).

Configuration of Main Sections

Next, the recovery device 100 will be described.

Figure 4:
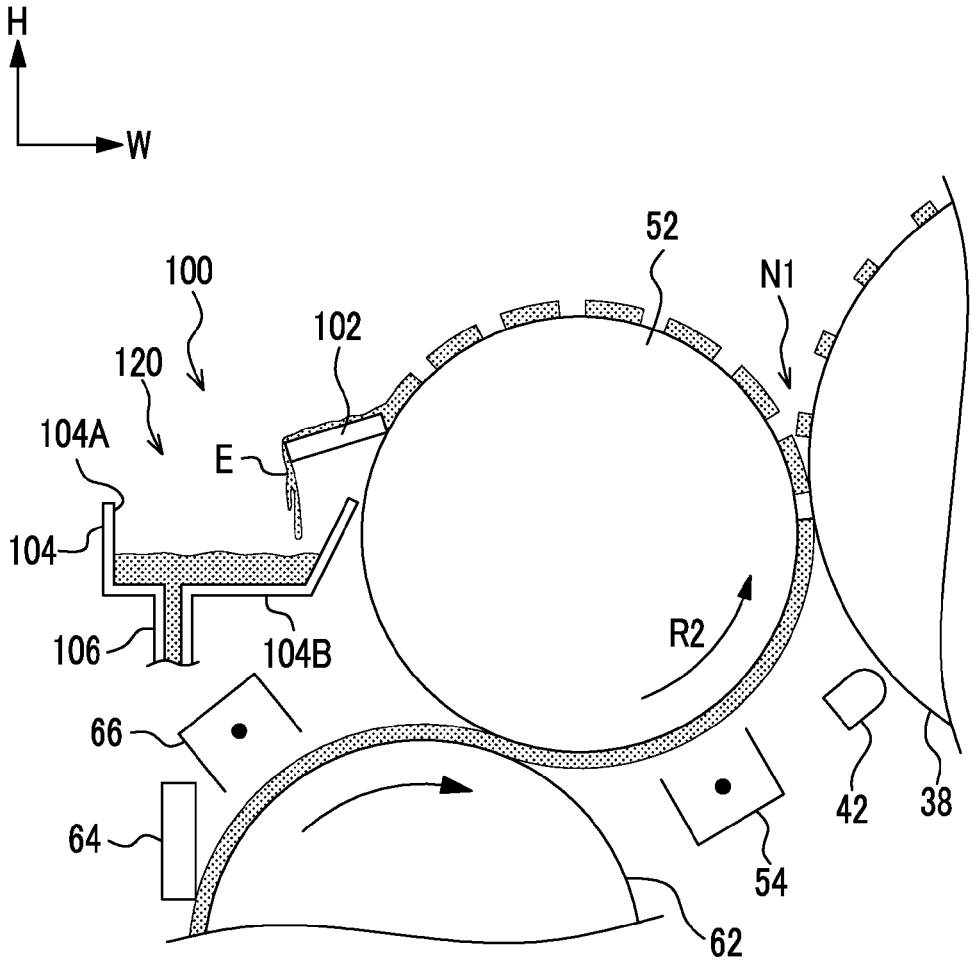
FIG. 4 is a configuration diagram that shows a developing device and the like of an image forming apparatus according to the first exemplary embodiment of the present invention.

As shown in FIG. 4, the recovery device 100 is provided with a scraping blade 102 as an example of a scraping member that scrapes away the liquid developer G which remains on the developing roller 52, and a recovery member 104, which recovers the liquid developer G, which is scraped away by the scraping blade 102. In the following descriptions, the liquid developer G, which is scraped away by the scraping blade 102, will be referred to as surplus developer E.

Furthermore, the recovery device 100 is provided with a dispersal device 130 (refer to FIG. 1), which disperses toner aggregates, which are included in the surplus developer E. Additionally, toner aggregates are aggregates of toner, which are formed by toner being charged as a result of being electrified by the electrification member 54, 66 or the like, and the charged toner aggregating.

Scraping Blade

The scraping blade 102 is a plate-shaped rubber blade that extends in a device depth direction (a paper surface depth direction), and an leading end section of the scraping blade 102 is in contact with the developing roller 52 in a portion that is on a downstream side with respect to the nipped section N1 in a rotational direction of the developing roller 52. Furthermore, the scraping blade 102 is inclined in such a manner that a portion of a leading end side of the scraping blade 102 is positioned on an upper side in comparison with a portion of a base end side thereof when viewed from the device depth direction.

In this instance, a toner concentration of the surplus developer E, which is scraped away from the developing roller 52 by the scraping blade 102, is mostly higher than a toner concentration of the liquid developer G that is supplied to the developing roller 52.

The reason why the toner concentration of the surplus developer E is high will be described below.

The following descriptions will be made focusing on the movement of toner and oil from the developing roller 52 to the image holder 38 in a case in which the electrostatic latent image that is formed on the image holder 38 is developed into a toner image and made visible.

In a case of the toner that is included in the liquid developer G, only toner of a portion in which the electrostatic latent image is formed moves from the developing roller 52 to the image holder 38, and toner of a portion in which the electrostatic latent image is not formed remains on the developing roller 52. Meanwhile, in a case of the oil that is included in the liquid developer G, half of the oil moves to the image holder 38, and the other half of the oil remains on the developing roller 52 as a result of surface tension of the oil with respect to the image holder 38 and surface tension of the oil with respect to the developing roller 52. As a result of this, oil layers of the same thickness are formed on the image holder 38 and the developing roller 52.

In this instance, it is rare for images of the same color to be formed on half of an output image or more. Therefore, the amount of toner that remains on the developing roller 52 is greater than the amount of toner that moves to the image holder 38. As a result of this, in the abovementioned manner, the toner concentration of the surplus developer E is higher than a toner concentration of the liquid developer G that is supplied to the developing roller 52. In addition, the viscosity of the surplus developer E is also high since the toner concentration of the surplus developer E is high.

Recovery Member

As shown in FIG. 4, the recovery member 104 extends in the device depth direction (the paper surface depth direction), and is disposed on a downstream side of the scraping blade 102. The recovery member 104 has a box-shape, has an opening section 104A, and is configured to recover the surplus developer E, which is scraped away by the scraping blade 102, through the opening section 104A.

Furthermore, a transport pipe 106, which transports the surplus developer E, which the recovery member 104 recovers, toward the dispersal device 130 (refer to FIG. 1), is connected to a bottom plate 104B of the recovery member 104.

In the manner described above, a recovery mechanism 120, which recovers the liquid developer G from the developing roller 52 is configured to include the scraping blade 102 and the recovery member 104.

Dispersal Device

As shown in FIG. 1, the dispersal device 130 is provided with a container 136, in which a reception section 132 that receives the surplus developer E, and a porous section 134 through which the surplus developer E passes, are formed, and a transport member 140, which transports the surplus developer E inside the container 136. Furthermore, the dispersal device 130 is provided with an addition mechanism 142 as an example of an addition member that adds a diluent L for reducing the toner concentration of the surplus developer E to the surplus developer E, which the reception section 132 receives.

Container

Figure 2:
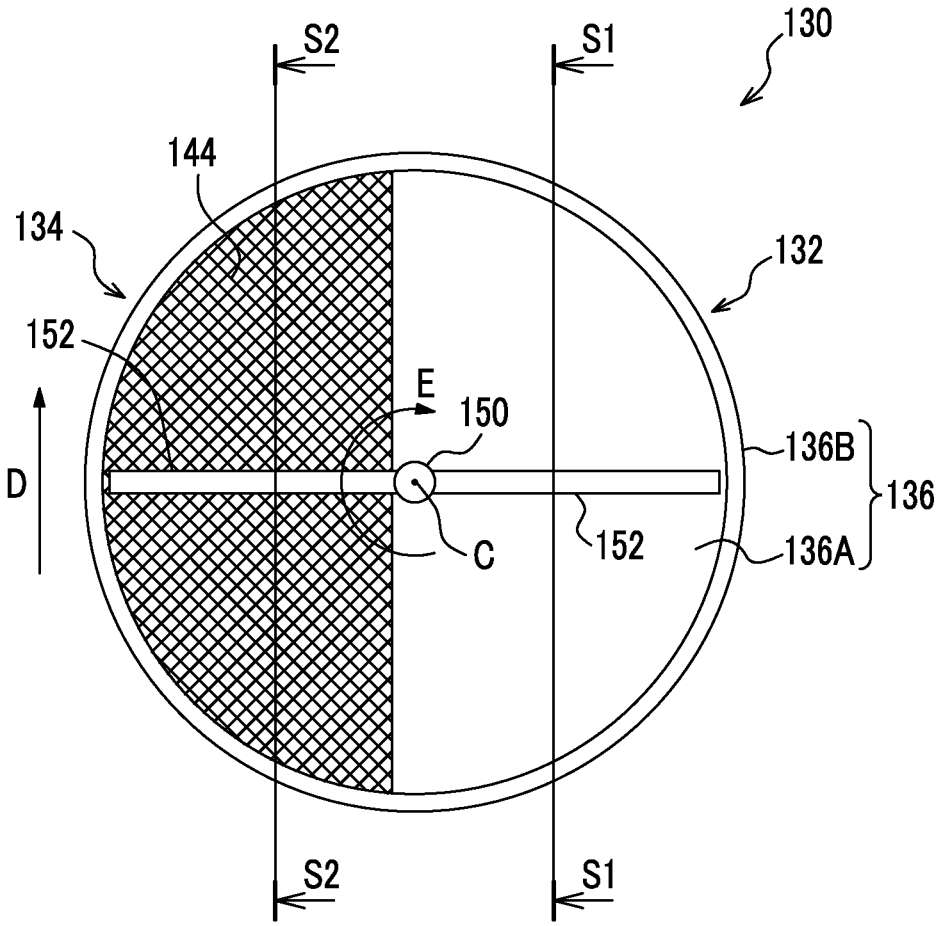
FIG. 2 is a drawing that shows a container and the like that are provided in the recovery device according to the first exemplary embodiment of the present invention.

As shown in FIGS. 1 and 2, the container 136 is configured to include a circular bottom plate 136A, and a side plate 136B that rises up from a peripheral edge of the bottom plate 136A to an upper side. Further, the container 136 is disposed so that the bottom plate 136A is inclined with respect to a horizontal plane.

In addition, in the container 136, a portion of a lower side (the right side in the drawing) with respect to a center C of the bottom plate 136A is set as the reception section 132, and a portion of an upper side (the left side in the drawing) with respect to the center C is set as the porous section 134. Furthermore, the reception section 132 is disposed on a lower side of a discharge section 106A of the transport pipe 106, and surplus developer E, which is discharged from the transport pipe 106, is received in the reception section 132.

Furthermore, the porous section 134 includes a net member 144 (mesh), through which the surplus developer E passes. More specifically, the net member 144 is formed by configuring a portion in the bottom plate 136A of an upper side with respect to the center C of the container 136 to have a net shape.

Addition Mechanism

As shown in FIG. 1, the addition mechanism 142 is provided with an accumulation tank 166, in which oil, which is a dispersal medium, is stored as the diluent L, a transport pipe 168 for transporting the diluent L, which is stored in the accumulation tank 166 to the reception section 132, and a pump 170. As a result of this, the diluent L is added to the surplus developer E, which the reception section 132 receives through the transport pipe 168, as a result of the pump 170 being operated, and the toner concentration of the surplus developer E is reduced.

Transport Member

The transport member 140 is provided with a rotating shaft member 150, which extends from the center C of the container 136 in a direction that is perpendicular to the bottom plate 136A, a pair of plate members 152, which are disposed on both sides of the rotating shaft member 150 with the rotating shaft member 150 interposed therebetween, and a motor 156, which applies a rotational force to the rotating shaft member 150.

The rotating shaft member 150 is set to be a column, and a pair of support members 154, sections of which have L-shapes (refer to FIGS. 3A and 3B), are attached to the rotating shaft member 150 so as to extend from an outer circumferential surface of the rotating shaft member 150 to an outer side in a radial direction thereof. Further, the pair of support members 154 are disposed so as to interpose the rotating shaft member 150.

Figure 3B:
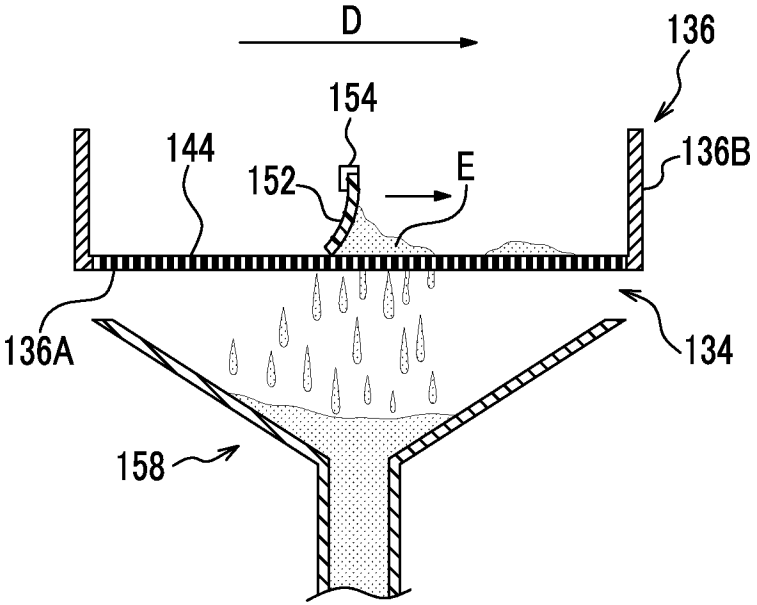
FIGS. 3A and 3B are sectional views that show the recovery device according to the first exemplary embodiment of the present invention.
Figure 3A:
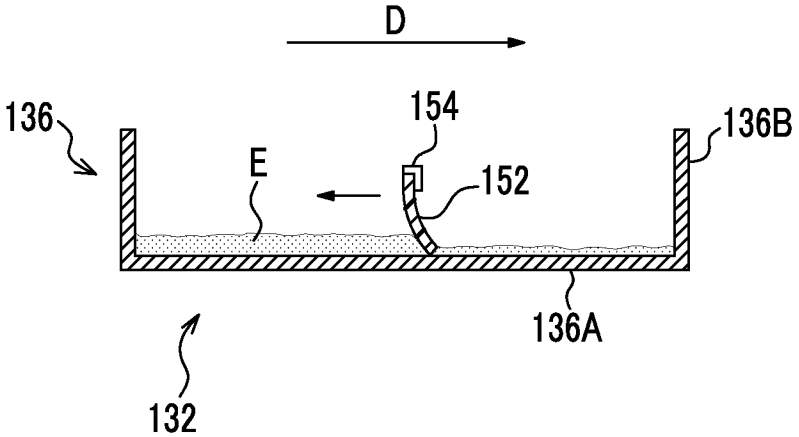

FIG. 3A shows a sectional view taken along line IIIA-IIIA in FIG. 2, and FIG. 3B shows a sectional view taken along line IIIB-IIIB in FIG. 2. As shown in FIGS. 3A and 3B, a portion of an upper end side of the plate member 152 is fixed to each support member 154 by a fixing unit, which is not shown in the drawing, and the respective support members 154 support the plate members 152.

The respective plate members 152 are formed using an elastic member (for example, a rubber material), and the external shapes thereof are rectangular. Further, the plate member 152 is elastically deformed so as to be warped in a curved form when viewed from a radial direction of the rotating shaft member 150 as a result of a portion of a lower end side of the plate member 152 being in contact with and being pressed against the bottom plate 136A.

In this configuration, the pair of plate members 152 revolve (move) in one direction as a result of a rotational force being applied to the rotating shaft member 150 by the motor 156 (refer to an arrow E in FIG. 2). Further, as shown in FIGS. 2 and 3A, the reception section 132 is configured such that the plate members 152, which revolve, transport the surplus developer E, which the reception section 132 receives, and the toner concentration of which is reduced by the addition of the diluent L, toward the porous section 134. Meanwhile, as shown in FIG. 3B, the porous section 134 is configured such that the plate members 152, which revolve, rub the surplus developer E, which is transported, against the net member 144 and cause the surplus developer E to pass through the net member 144.

Additionally, a funnel member 158, which collects the surplus developer E that has passed through the porous section 134, is disposed on a lower side of the porous section 134, and the surplus developer E, which is collected by the funnel member 158, is transported to a concentration adjustment section, which is not shown in the drawing.

Actions of Main Sections

Next, the actions of the main sections will be described. The supply roller 62, which rotates, draws up the liquid developer G that is accommodated in the developer tank 60. Further, the blade 64 adjusts the layered film of the liquid developer G, and the electrification device 66 electrifies the toner that is included in the liquid developer G (refer to FIG. 5). Further, the liquid developer G is supplied from the supply roller 62, which rotates, to the developing roller 52, which rotates. Furthermore, the electrification member 54 electrifies the toner that is included in the liquid developer G, which is supplied to the developing roller 52, and a portion of the liquid developer G which includes the electrified toner, is delivered from the developing roller 52 to the electrostatic latent image that is formed on the image holder 38. As a result of this, the electrostatic latent image is developed (made visible) as a toner image.

In addition, as shown in FIG. 4, the liquid developer G which is not delivered to the image holder 38 and remains on the developing roller 52 is scraped away by the scraping blade 102. In this instance, the liquid developer G which remains on the developing roller 52 includes toner aggregates which are formed by toner being charged as a result of being electrified by the electrification member 54, 66 or the like, and the toner aggregating.

Further, the surplus developer E which is scraped away by the scraping blade 102, flows across the surface (a surface that faces upward in the drawing) of the scraping blade 102, falls from a base end side of the scraping blade 102, and is recovered by the recovery member 104 through the opening section 104A. Furthermore, the surplus developer E which is recovered by the recovery member 104, is transported toward the dispersal device 130 (not shown in FIG. 4) by the transport pipe 106.

As shown in FIG. 1, the surplus developer E which is transported by the transport pipe 106, is discharged toward the reception section 132 from the discharge section 106A of the transport pipe 106, and received by the reception section 132.

Meanwhile, the diluent L is added to the surplus developer E which passes through the transport pipe 168 and is received by the reception section 132. As a result of this, the toner concentration of the surplus developer E is reduced.

Further, as shown in FIGS. 2 and 3A, in the reception section 132, the plate member 152, which revolves, transports the surplus developer E, the toner concentration of which is reduced, toward the porous section 134. In addition, as shown in FIG. 3B, in the porous section 134, the plate member 152, which revolves, rubs the surplus developer E, which is transported, against the net member 144 and causes the surplus developer E to pass through the net member 144.

The toner aggregates which are included in the surplus developer E, are dispersed as a result of the surplus developer E being rubbed against and passing through the net member 144 by the plate member 152.

The surplus developer E in which the toner aggregates have been dispersed, is collected by the funnel member 158, and transported to the concentration adjustment section, which is not shown in the drawing.

Summary

In this manner, as a result of causing the surplus developer E, the toner concentration of which is reduced by adding the diluent L thereto, to pass through the porous section 134, the toner aggregates which are included in the surplus developer E are effectively dispersed in comparison with a case in which the recovered surplus developer E passes through the porous section 134 without change.

In addition, as a result of the plate members 152 rubbing the surplus developer E against the net member 144 and causing the surplus developer E to pass through the net member 144, toner aggregates are effectively dispersed in comparison with a case in which the surplus developer E is not rubbed against the net member 144.

In addition, as a result of the plate member 152 revolving (moving) in one direction, the surplus developer E which the reception section 132 receives is transported to the porous section 134, and the surplus developer E is rubbed against the net member 144 and caused to pass through the net member 144. In this manner, the surplus developer E is transported and caused to pass through the net member 144 as a result of only rotating the plate member 152 in one direction.

In addition, in the image forming apparatus 10, as a result of the toner aggregates, which are included in the surplus developer E, being dispersed, the reuse of a larger amount of the surplus developer E is made possible in comparison with a case in which the toner aggregates are not dispersed.

Second Exemplary Embodiment

Next, an example of a recovery device and an image forming apparatus according to a second exemplary embodiment of the present invention will be described with reference to FIGS. 7 and 8. Additionally, the same symbols will be given to members and the like which are the same as the first exemplary embodiment, description thereof will be omitted, and primarily, portions which differ from the first exemplary embodiment will be described.

Dispersal Device

Figure 7:
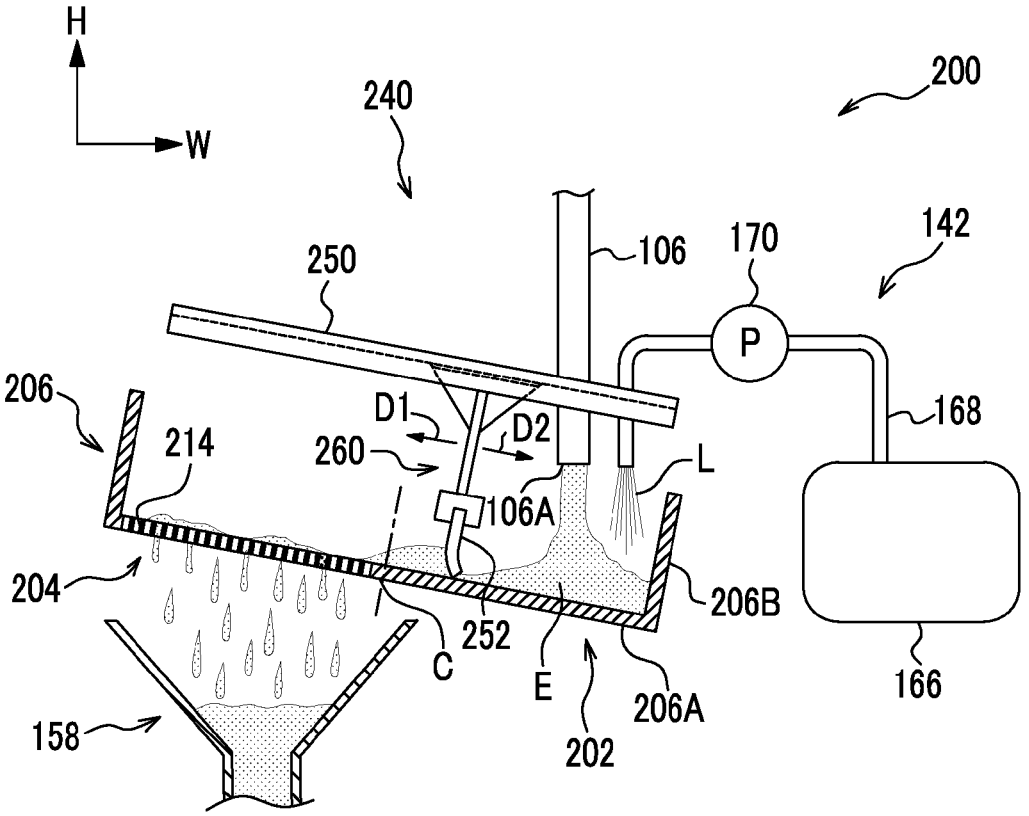
FIG. 7 is a configuration diagram that shows a recovery device and the like according to a second exemplary embodiment of the present invention.

As shown in FIG. 7, a dispersal device 200 according to the second exemplary embodiment is provided with a container 206, in which a reception section 202 that receives the surplus developer E, and a porous section 204 through which the surplus developer E passes, are formed, and a transport member 240, which transports the surplus developer E inside the container 206.

Container

Figure 8:
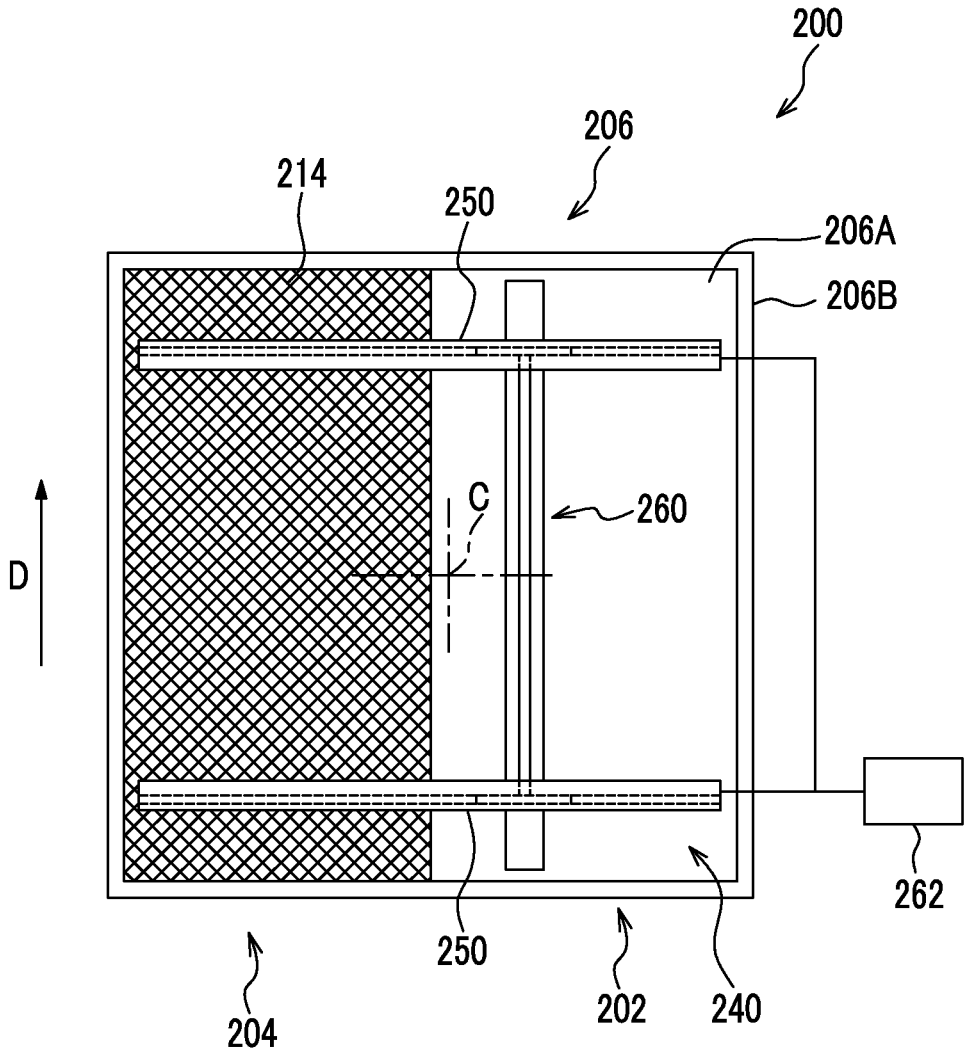
FIG. 8 is a drawing that shows a container and the like that are provided in the recovery device according to the second exemplary embodiment of the present invention.

As shown in FIGS. 7 and 8, the container 206 is configured to include a rectangular bottom plate 206A, and a side plate 206B that rises up from a peripheral edge of the bottom plate 206A to an upper side. Further, the container 206 is disposed so that the bottom plate 206A is inclined with respect to a horizontal plane.

In addition, in the container 206, a portion of a lower side (the right side in the drawing) with respect to a center C (the center in a left-right direction in the drawing) of the container 206 is set as a reception section 202, and a portion of an upper side (the left side in the drawing) with respect to the center C is set as a porous section 204. Further, the reception section 202 is disposed on a lower side of a discharge section 106A of the transport pipe 106, and the reception section 202 receives surplus developer E, which is discharged from the transport pipe 106.

Furthermore, the porous section 204 includes a net member 214 (mesh), through which the surplus developer E passes. More specifically, in the bottom plate 206A, the net member 214 is formed by configuring a portion in the bottom plate 206A of an upper side with respect to the center C of the container 206 to have a net shape.

Transport Member

The transport member 240 is provided with a plate member 252, a pair of guide rails 250, which are separated in the device depth direction on an upper side of the container 206, and a support member 260, which is guided by the guide rails 250 and supports the plate member 252. Furthermore, the transport member 240 is provided with a driving member 262, which applies a movement force to the support member 260 in such a manner that the support member 260 is guided by the guide rails 250.

The pair of guide rails 250 are disposed so as to extend over the reception section 202 and the porous section 204 when viewed from an upper side (refer to FIG. 8), and are inclined at the same angle as the bottom plate 206A when viewed from a lateral side (refer to FIG. 7).

The support member 260 supports a portion of an upper end side of the plate member 252, and is supported in a moveable manner by the guide rails 250.

The plate member 252 is formed using an elastic member (for example, a rubber material), and the external shape thereof is rectangular. Further, the plate member 252 is elastically deformed so as to be warped in a curved form when viewed from a lateral side as a result of a portion of a lower end side of the plate member 252 being in contact with and being pressed against the bottom plate 206A.

In this configuration, the plate member 252 moves in a first direction as a result of the driving member 262 applying a movement force to the support member 260 in the first direction (the direction of an arrow D1 in FIG. 7) in a case in which the plate member 252 is positioned in the reception section 202. Further, the reception section 202 is configured such that the plate member 252, which moves, transports the surplus developer E, the toner concentration of which has been reduced as a result of the addition of the diluent L, toward the porous section 204. Meanwhile, the porous section 204 is configured such that the plate member 252, which moves, rubs the surplus developer E, which is transported, against the net member 214 and causes the surplus developer E to pass through the net member 214.

Furthermore, after the plate member 252 causes the surplus developer E to pass through the net member 214, the plate member 252 moves in a second direction as a result of the driving member 262 applying a movement force to the support member 260 in the second direction (the direction of an arrow D2 in FIG. 7). Further, the plate member 252 returns to the reception section 202, and the step is repeated. Since the plate member 252 curves in a convex manner in a movement direction when viewed from a lateral side, in a case of moving in the second direction, the plate member 252 curves on the opposite side to a case of moving in the first direction.

Additionally, the present invention has been described in detail using specific exemplary embodiments, but the present invention is not limited to the exemplary embodiments, and the fact that it is possible to adopt a variety of other exemplary embodiments within the range of the present invention would be obvious to a person skilled in the art. For example, in abovementioned first and second exemplary embodiments, the recovery device 100 is used in order to recover the liquid developer G that remains on the developing roller 52, but the recovery device 100 may also be used in order to recover the liquid developer G that remains on the image holder 38 or the liquid developer G that remains on the transfer roller 34A.

In addition, in abovementioned first and second exemplary embodiments, the addition mechanism 142 adds the diluent L to the surplus developer E which the reception section 132 receives, but the diluent L may also be added to the surplus developer E in a state prior to being received by the reception section 132.

In addition, in abovementioned first and second exemplary embodiments, the containers 136 and 206 are disposed so that the bottom plates 136A and 206A are inclined with respect to a horizontal plane, but the bottom plates may be parallel to a horizontal plane.

In addition, in abovementioned first and second exemplary embodiments, oil, which is a dispersal medium, is used as the diluent L, but a low concentration developer, the toner concentration of which is lower than the liquid developer G, may also be used as the diluent L.

In addition, in abovementioned first and second exemplary embodiments, the surplus developer E are caused to pass through the net members 144 and 214, but may also be caused to pass through a porous member, in which many holes are formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recovery device comprising:

a recovery mechanism that recovers a liquid developer from a holding member which revolves while holding the liquid developer, the liquid developer being not delivered from the holding member to a delivery target member and remains on the holding member;

a reception section that receives the liquid developer which the recovery mechanism recovers;

an addition member that adds a diluent, which reduces a toner concentration of the liquid developer, to the liquid developer that the reception section receives;

a porous section through which the liquid developer passes;

a container, in which the reception section and the porous section are formed, the container having a bottom plate that is inclined with respect to a horizontal plane, wherein a lower side portion of the bottom plate with respect to a center of the bottom plate is set as the reception section, and an upper side portion of the bottom plate with respect to the center of the bottom plate is set as the porous section; and a transport member that moves to transport the liquid developer which the reception section receives to the porous section, and causes the liquid developer to pass through the porous section.

2. The recovery device according to claim 1, wherein the porous section includes a net member through which the liquid developer passes, the transport member includes a plate member, and the plate member that moves, and rubs the liquid developer against the net member to cause the liquid developer to pass through the net member.

3. The recovery device according to claim 2, wherein the plate member moves in one direction to transport the liquid developer, which the reception section receives, to the porous section, and rubs the liquid developer against the net member to cause the liquid developer to pass through the net member.

4. An image forming apparatus comprising:

an image holder on which electrostatic latent images are formed while the image holder revolves;

a developing member that delivers a liquid developer to the image holder while revolving, and develops the electrostatic latent images as toner images;

a transfer member that transfers the toner images to a recording medium; and the recovery device according to claim 2 that recovers the liquid developer from at least one of the image holder and the developing member.

5. An image forming apparatus comprising:

an image holder on which electrostatic latent images are formed while the image holder revolves;

a developing member that delivers a liquid developer to the image holder while revolving, and develops the electrostatic latent images as toner images;

a transfer member that transfers the toner images to a recording medium; and the recovery device according to claim 1 that recovers the liquid developer from at least one of the image holder and the developing member.

6. The recovery device according to claim 1, wherein the diluent is a dispersal medium or a developer having a concentration lower than a concentration of the liquid developer.

* * * * *